US007435137B2

(12) United States Patent
Onoda et al.

(10) Patent No.: US 7,435,137 B2
(45) Date of Patent: Oct. 14, 2008

(54) LOCK STRUCTURE

(75) Inventors: Katsuhiko Onoda, Makinohara (JP); Tomokazu Yamane, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/700,079

(22) Filed: Jan. 31, 2007

(65) Prior Publication Data

US 2007/0218779 A1 Sep. 20, 2007

(30) Foreign Application Priority Data

Mar. 17, 2006 (JP) ..... 2006-075220

(51) Int. Cl.
*H01R 13/40* (2006.01)

(52) U.S. Cl. ..... 439/595

(58) Field of Classification Search ..... 439/595, 439/752

See application file for complete search history.

(56) References Cited

U.S. PATENT DOCUMENTS 5,516,308 A * 5/1996 Yamanashi ..... 439/752
5,931,700 A * 8/1999 Saito et al. ..... 439/595
6,682,367 B2 * 1/2004 Suzuki ..... 439/595
6,902,443 B2 * 6/2005 Hara et al. ..... 439/752
2002/0168895 A1 * 11/2002 Suzuki ..... 439/595
2002/0168896 A1 * 11/2002 Suzuki ..... 439/595

FOREIGN PATENT DOCUMENTS

JP 2001-250627 A 9/2001

* cited by examiner

*Primary Examiner*—Gary F. Paumen
(74) *Attorney, Agent, or Firm*—Sughrue Mion, PLLC

(57) ABSTRACT

There is provided a lock structure of two articles which are attached to each other by fitting one article on the other article. The lock structure includes a lock arm formed at one of the two articles, and an arm reception portion which has a retaining portion for retaining engagement with the lock arm, and is formed at the other of the two articles. During the time when the one article is attached to the other article, the lock arm is brought into abutting engagement with the arm reception portion, and is elastically deformed to slide past the retaining portion, and becomes engaged with the retaining portion. The arm reception portion has a guide portion extending to the retaining portion, and a distal end portion of the lock arm is received between the guide portion and an outer surface of the other article.

7 Claims, 7 Drawing Sheets

LOCK STRUCTURE

BACKGROUND OF THE INVENTION

1. Field of the Invention

This invention relates to a lock structure of two articles which are attached to each other.

2. Related Art

As a lock structure of two articles to be attached to each other, there is known a lock structure of connector housings (see, for example, JP-A-2001-250627 Publication).

As shown in FIG. 11, a connector 100 disclosed in Patent Literature 1 comprises two connector housings 101 and 102 stacked together in a vertical direction. The upper connector housing 101 has a downwardly-projecting lock claw 103, and the lower connector housing 102 has a lock claw 104 for engagement with the lock claw 103. An upwardly-projecting fitting protrusion 105 is formed at the lock claw 104 of the connector housing 102, and the connector housing 101 has a fitting recess 106 through which the fitting protrusion 105 can fittingly pass.

At the time of attaching the two connector housings 101 and 102 to each other, the two lock claws 103 and 104 are brought into engagement with each other by elastically deforming the lock claw 104 outwardly (in a direction of arrow A parallel to the sheet of FIG. 11). At this time, the fitting protrusion 105 is fittingly passed through the fitting recess 106, thereby preventing the lock claw 104 from excessive elastic deformation.

Incidentally, there is a tendency for external dimensions (such as a thickness) of a connector to be reduced in order to meet a recent demand for a compact design of connectors. Under the circumstances, in the connector disclosed in JP-A-2001-250627 Publication, it may be proposed to form the lock claws 103 and 104 into a thin, flattened shape. Such thin lock claws 103 and 104 are liable to be deformed in a direction of their thickness (that is, in a direction perpendicular to the sheet of FIG. 11), and therefore there is a fear that the lock claws 103 and 104 may be incompletely engaged with each other or may be broken when the lock claw is deformed in a direction different from the predetermined direction of arrow A.

SUMMARY OF THE INVENTION

This invention has been made in view of the above circumstances, and an object of the invention is to provide a lock structure which prevents incomplete engagement and breakage of a lock arm, thereby positively attaching two articles to each other.

The above object has been achieved by the following lock structure of the present invention.

A lock structure of two articles which are attached to each other is characterized in that the lock structure includes a lock arm formed at one of the two articles, and an arm reception portion which has a retaining portion for retaining engagement with the lock arm, and is formed at the other of the two articles; and the two articles are attached to each other by fitting one of the two articles on the other, and during the time when the one article is attached to the other article, the lock arm is brought into abutting engagement with the arm reception portion, and is elastically deformed to slide past the retaining portion, and becomes engaged with the retaining portion; and the arm reception portion has a guide portion extending to the retaining portion, and a distal end portion of the lock arm is received between the guide portion and an outer surface of the other article.

In the lock structure of the invention, when the two articles are attached to each other, the lock arm is brought into abutting engagement with the arm reception portion, and is elastically deformed to slide past the retaining portion, and is brought into retaining engagement with this retaining portion. During the elastic deformation of the lock arm, the distal end portion thereof is received between the outer surface of the other article (on which the one article is fitted) and the guide portion of the arm reception portion. Therefore, the lock arm is prevented from being deformed away from the outer surface of the other article, and is always caused to be elastically deformed in generally parallel contiguous relation to the outer surface of the other article. Therefore, improper deformation of the lock arm can be eliminated, thereby preventing incomplete engagement and breakage of the lock arm.

Another aspect of the invention provides a connector including:

a tubular inner housing having a generally rectangular cross-section;

an outer housing capable of fitting to the the inner housing;

an elastically deformable lock arm formed on one of the inner housing and the outer housing, extending in a connector fitting direction of the tubular body; and a strip-like arm reception portion formed on the other of the inner housing and the outer housing, extending in the connector fitting direction of the tubular body;

wherein a provisionally retaining portion and a completely-retaining portion are formed respectively at a first end and a second end of the arm reception portion, so that a guide groove is defined along the connector fitting direction between the provisionally-retaining portion and the completely-retaining portion, and the inner housing and the outer housing are provisionally fixable to each other by engaging the lock arm with the provisionally-retaining portion, the inner housing and the outer housing are completely fixable to each other by engaging the lock arm with the completely-retaining portion, after moving the lock arm from the provisionally-retaining portion to the completely-retaining portion in the guide groove.

DETAILED DESCRIPTION OF THE PREFERRED EMBODIMENTS

A preferred embodiment of a connector of the present invention will now be described with reference to the drawings.

Figure 1:
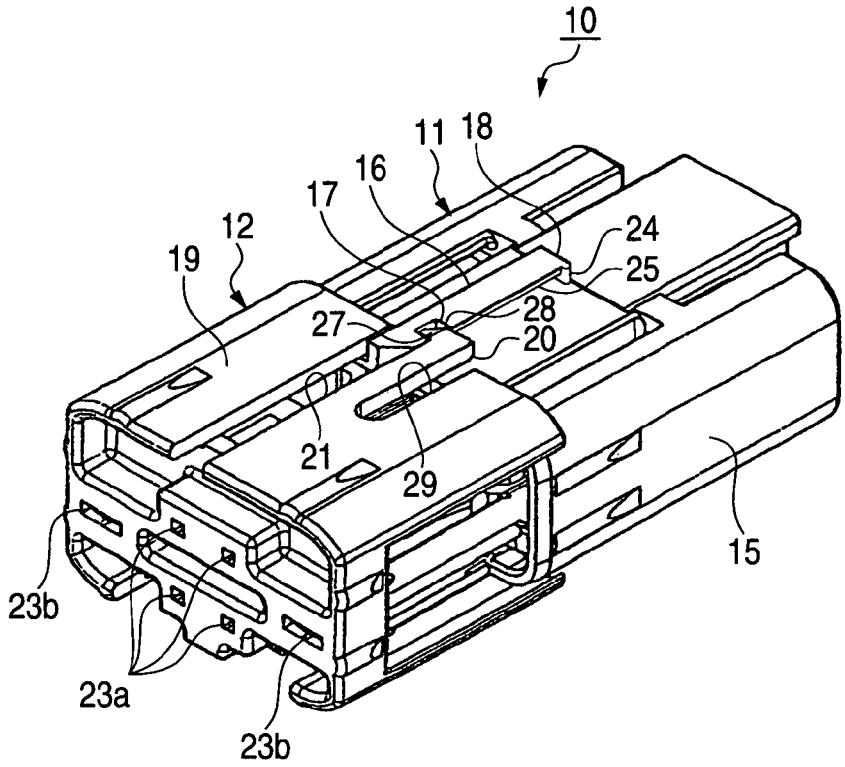
FIG. 1 is a perspective view of a connector to which one preferred embodiment of a lock structure of the present invention is applied.
Figure 2:
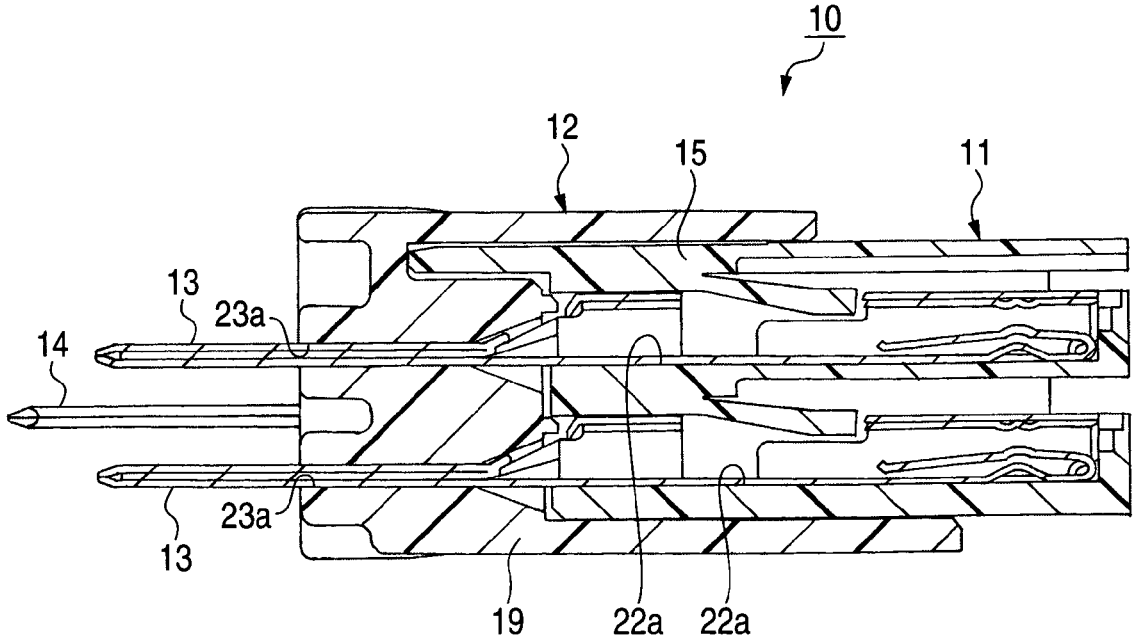
FIG. 2 is a cross-sectional view of the connector of FIG. 1.
Figure 3:
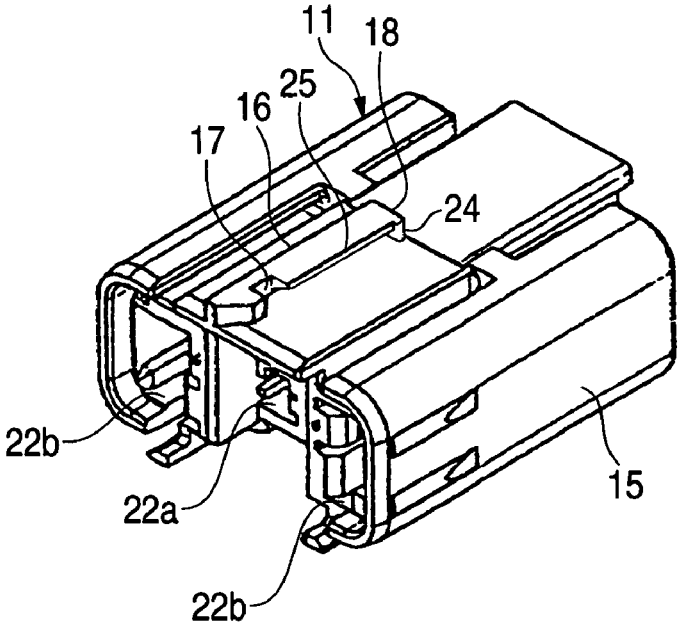
FIG. 3 is a perspective view of an inner housing of the connector of FIG. 1, showing its appearance.
Figure 4:
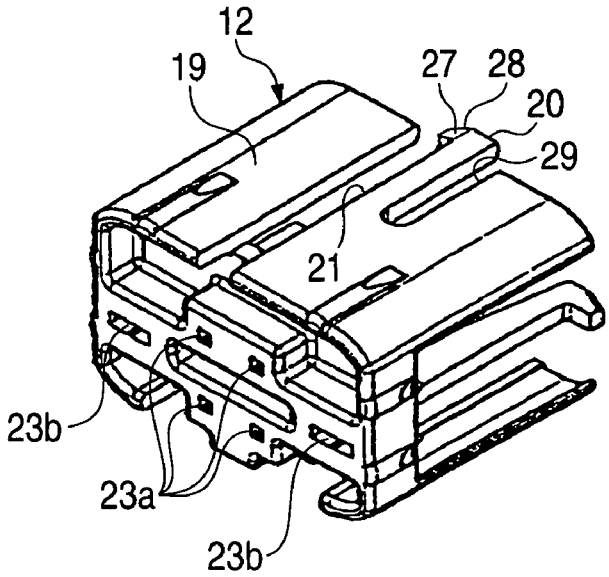
FIG. 4 is a perspective view of an outer housing of the connector of FIG. 1, showing its appearance.
Figure 5:
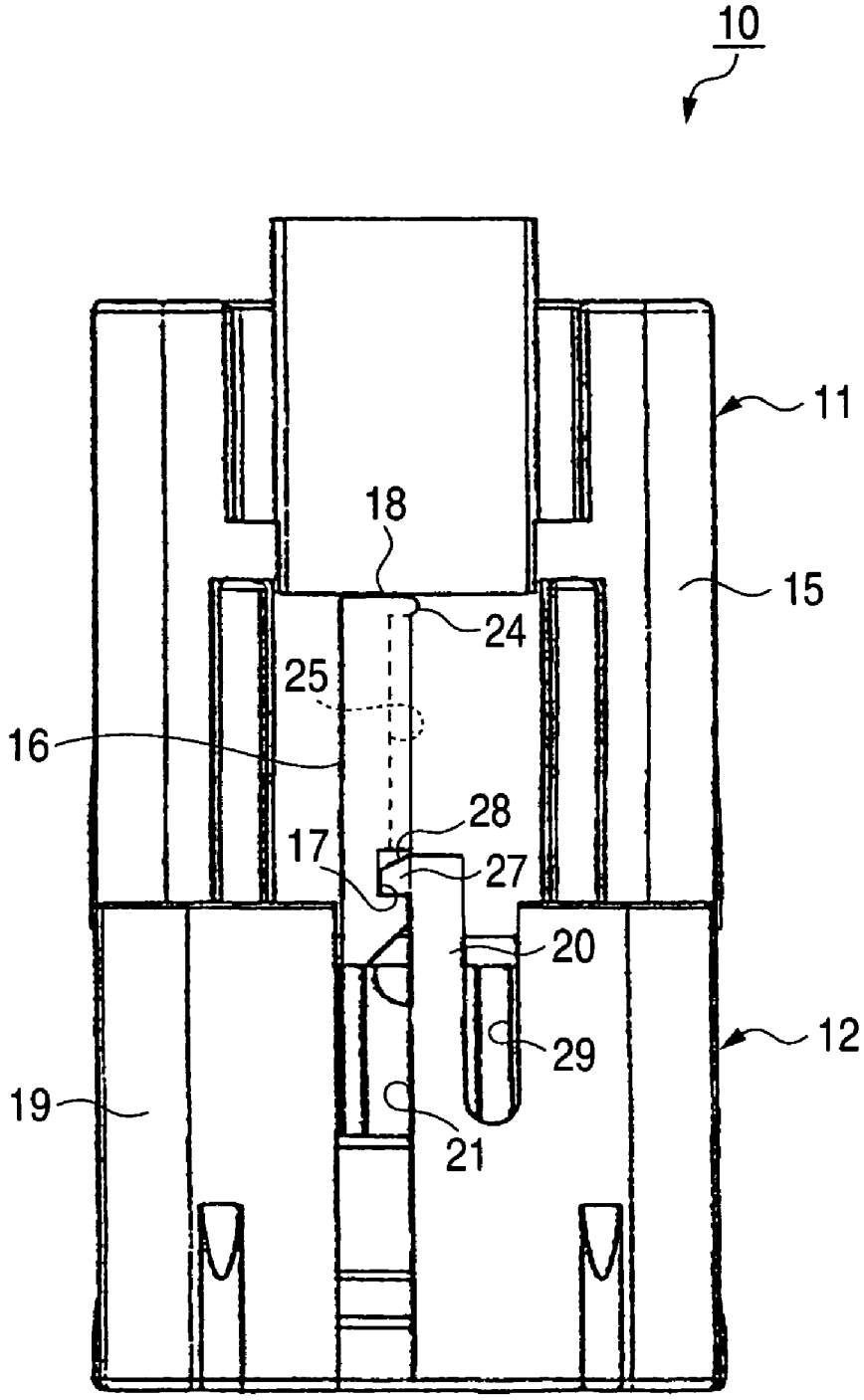
FIG. 5 is a plan view showing the connector of FIG. 1 in its provisionally-fixed condition.
Figure 6:
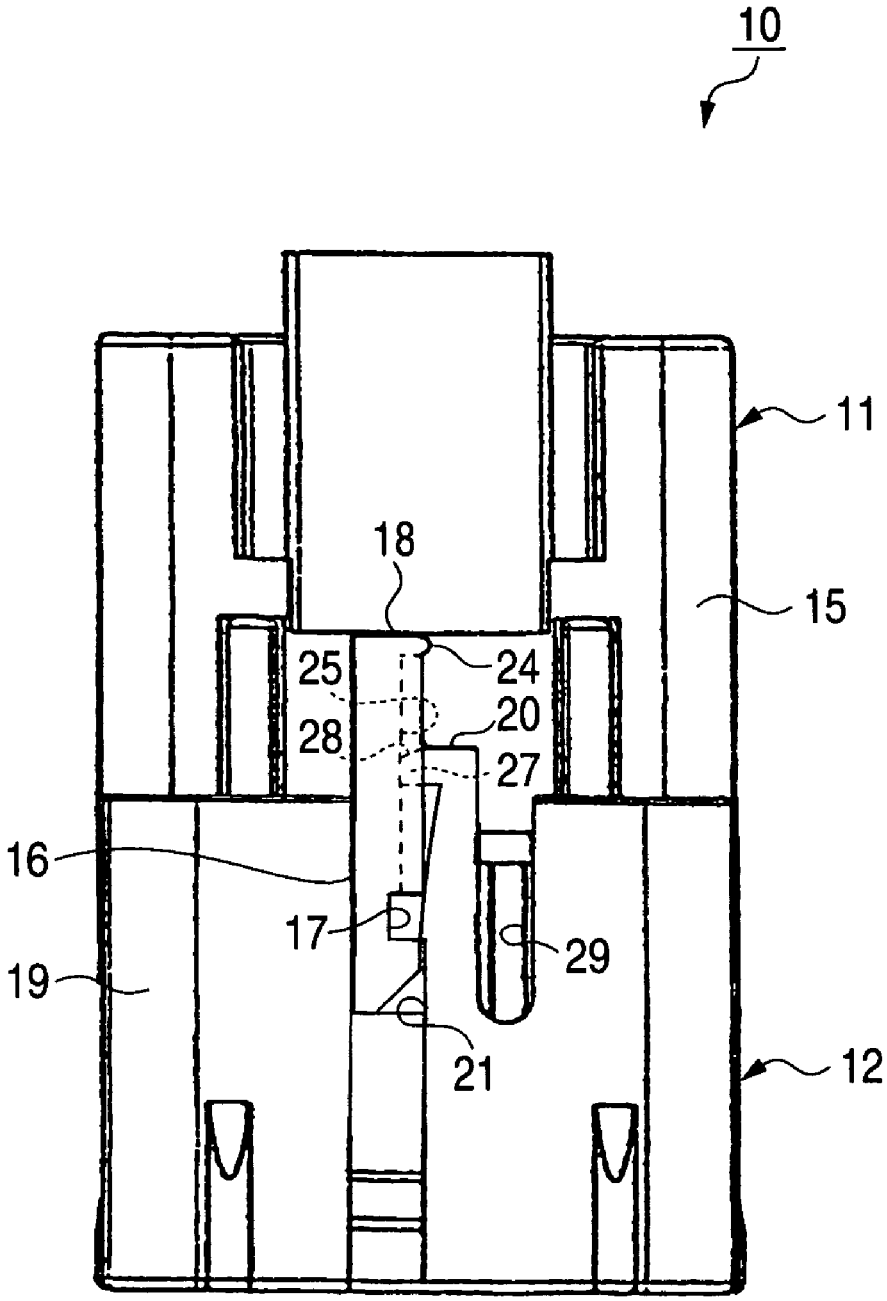
FIG. 6 is a plan view showing a process of shifting of the connector of FIG. 1 from the provisionally-fixed condition to a completely-fixed condition.
Figure 7:
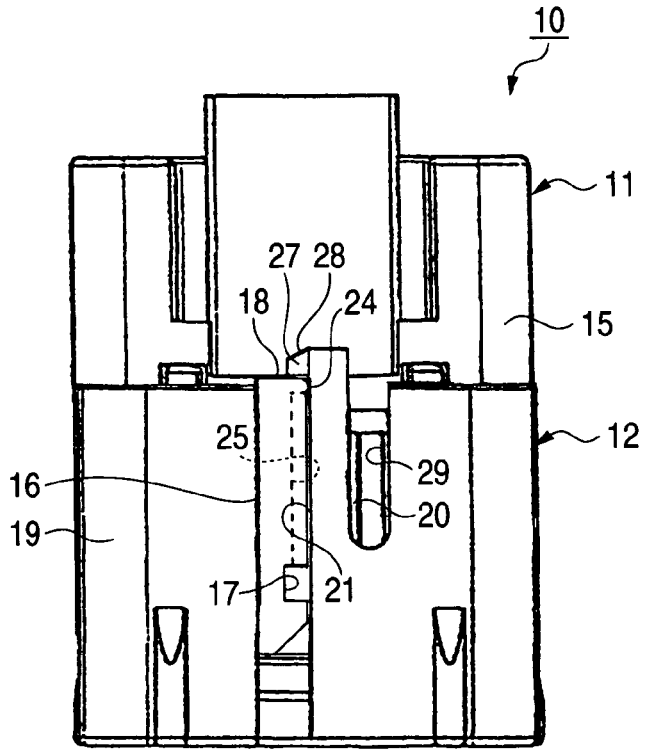
FIG. 7 is a plan view of the connector of FIG. 1 in the completely-fixed condition.

FIG. 1 is a perspective view of a connector to which one preferred embodiment of a lock structure of the invention is applied, FIG. 2 is a cross-sectional view of the connector of FIG. 1, FIG. 3 is a perspective view of an inner housing of the connector of FIG. 1, showing its appearance, FIG. 4 is a perspective view of an outer housing of the connector of FIG. 1, showing its appearance, FIG. 5 is a plan view showing the connector of FIG. 1 in its provisionally-fixed condition, FIG. 6 is a plan view showing a process of shifting of the connector of FIG. 1 from the provisionally-fixed condition to a completely-fixed condition, and FIG. 7 is a plan view of the connector of FIG. 1 in the completely-fixed condition.

As shown in FIGS. 1 to 4, the connector 10 of this embodiment comprises the inner housing 11, and the outer housing 12 attached to this inner housing 11.

The inner housing 11 includes a tubular body 15 of a generally rectangular cross-section. Four first terminal receiving chambers 22*a* are formed within the body 15, and are arranged in two rows and two columns, and extend in a forward-rearward direction, that is, in an axial direction of the body 15 (namely, connector fitting direction). Further, two second terminal receiving chambers 22*b* are formed within the body 15, and are disposed respectively at opposite (right and left) sides of the group of (four) first terminal receiving chambers 22*a*. First terminals 13 are inserted respectively into the first terminal receiving chambers 22*a*, and second terminals 14 are inserted respectively into the second terminal receiving chambers 22*b*.

The outer housing 12 is attached to the inner housing 11 from the rear side of the inner housing 11 in the direction of insertion of the terminals 13 and 14 into the respective terminal receiving chambers 22*a* and 22*b*. FIG. 1 shows a condition in which the outer housing 12 is provisionally fixed to a rear end portion of the inner housing 11.

A strip-like arm reception portion 16 is formed in a projected manner on an upper surface of the body 15 of the inner housing 11, and extends in the forward-rearward direction, that is, in the axial direction of the body 15. A provisionally-retaining portion 17 is formed at a rear end portion of the arm reception portion 16, and a front end of the arm reception portion 16 serves as a completely-retaining portion 18.

The outer housing 12 includes a hood portion 19 which is formed into such a tubular shape as to fit on the body 15 of the inner housing 11. A receiving groove 21 is formed through an upper wall of the hood portion 19 superposed on the upper surface of the body 15, and extends from a front edge of the upper wall to a rear edge thereof along the connector fitting direction. Also, a slit 29 is formed through this upper wall, and extends rearwardly from the front edge of the upper wall in parallel adjacent relation to the receiving groove 21 such that a lock arm 20 is formed between the receiving groove 21 and the slit 29.

The rear end portion of the arm reception portion 16 formed at the body 15 of the inner housing 11 is received in the receiving groove 21 in the hood portion 19 of the outer housing 12, and also the lock arm 20 is engaged with the provisionally-retaining portion 17 of the arm reception portion 16, thereby provisionally fixing the outer housing 12 to the inner housing 11.

Then, the outer housing 12 is further moved forward with the arm reception portion 16 received in the receiving groove 21 in the hood portion 19, so that the lock arm 20 is brought into engagement with the completely-retaining portion 18 formed at the front end of the arm reception portion 16, thereby completely fixing the outer housing 12 to the inner housing 11.

The rear end of the tubular outer housing 12 is closed by a bottom plate, and four first terminal passage holes 23*a* are formed through a central portion of the bottom plate, and also two second terminal passage holes 23*b* are formed through the bottom plate, and are disposed respectively at opposite sides of the group of (four) first terminal passage holes 23*a*. The outer housing 12 is moved from the provisionally-fixed position to the completely-fixed position, and at this time proximal end portions of the first terminals 13 received in the respective first terminal receiving chambers 22*a* of the inner housing 11 pass respectively through the first terminal passage holes 23*a*, and also proximal end portions of the second terminals 14 received in the respective second terminal receiving chambers 22*b* of the inner housing 11 pass respectively through the second terminal passage holes 23*b*.

As described above, the strip-like arm reception portion 16 is formed in a projected manner on the upper surface of the body 15 of the inner housing 11, and extends in the forward-rearward direction, that is, in the axial direction of the body 15, and the provisionally-retaining portion 17 is formed at the rear end portion of this arm reception portion 16, and the front end of the arm reception portion 16 serves as the completely-retaining portion 18. The provisionally-retaining portion 17 is in the form of a recess formed in one side edge surface of the arm reception portion 16.

A guide groove 25 is formed in the arm reception portion 16, and extends between the provisionally-retaining portion 17 and the completely-retaining portion 18. The guide groove 25 is formed in the one side edge surface (in which the provisionally-retaining portion is formed) of the arm reception portion 16, and extends from the provisionally-retaining portion 17 to the completely-retaining portion 18 along the upper surface of the body 15.

A rear end of the guide groove 25 formed in the one side edge surface of the arm reception portion 16 is open to the provisionally retaining portion 17 which is the recess also formed in the one side edge surface of the arm reception portion 16. The guide groove 25 is smaller in depth than the provisionally-retaining portion 17, and the rear end of the guide groove 25 communicates with the provisionally-retaining portion 17 with a step formed therebetween. Also, an interconnecting portion 24 which interconnects the front end of the guide groove 25 and the completely-retaining portion 18 forms a step.

A retaining claw 27 is formed on and projects laterally from the distal end portion of the lock arm 20, and a front surface 28 of the retaining claw 27 is formed into an inclining surface.

Next, the shifting of the outer housing 12 from the provisionally-fixed condition to the completely-fixed condition will be described with reference to FIGS. 5 to 7.

In the provisionally-fixed condition of the outer housing 12 shown in FIG. 5, the retaining claw 27 of the lock arm 20 is fitted in the provisionally-retaining portion 17 laterally of the arm reception portion 16, and is engaged with this portion 17.

When the outer housing 12 is further moved forward, with the arm reception portion 16 of the inner housing 11 kept received in the receiving groove 21 of the hood portion 19, the retaining claw 27 received in the provisionally-retaining portion 17 abuts at its inclining front surface 28 against the step between the provisionally-retaining portion 17 and the guide portion 25, so that the lock arm 20 is elastically deformed.

During elastic deformation of the lock arm 20, the retaining claw 27 formed at the distal end of the lock arm 20 is received in the guide groove 25 extending along the upper surface of the body 15 of the inner housing 11, and in other words the retaining claw 27 is received between the upper surface of the body 15 of the inner housing 11 and an overhanging portion (guide portion) remaining at an upper edge portion of the one side edge surface (in which the guide groove 25 is formed) of the arm reception portion 16. Therefore, the lock arm 20 is prevented from being elastically deformed away from the upper surface of the body 15 of the inner housing 11. Therefore, the lock arm 20 is elastically deformed in generally parallel contiguous relation to the upper surface of the body 15 of the inner housing 11 as shown in FIG. 6.

When the outer housing 12 is further moved forward, with the arm reception portion 16 of the inner housing 11 kept received in the receiving groove 21 of the hood portion 19, the retaining claw 27 of the lock arm 20 reaches the front end of the guide portion 25, and abuts at its inclining front surface 28 against the interconnecting portion 24. The lock arm 20 is further elastically deformed in generally parallel contiguous relation to the upper surface of the body 15, and the retaining claw 27 slides past the interconnecting portion 24, and becomes engaged with the completely-retaining retaining portion 18 as shown in FIG. 7. As a result, the outer housing 12 is completely fixed to the inner housing 11.

As described above, in the lock structure of this embodiment, when the inner housing 11 and the outer housing 12 are attached to each other, the lock arm 20 is brought into abutting engagement with the arm reception portion 16, and is elastically deformed to slide past the completely-retaining portion 18, and is brought into retaining engagement with this completely-retaining portion 18. During the elastic deformation of the lock arm 20, the retaining claw 27 formed at the distal end thereof is received between the upper surface of the body 15 of the inner housing 11 (on which the outer housing 12 is fitted) and the overhanging portion (guide portion) remaining at the upper edge portion of the one side edge surface (in which the guide groove 25 is formed) of the arm reception portion 16. Therefore, the lock arm 20 is prevented from being deformed away from the upper surface of the body 15 of the inner housing 11, and is always caused to be elastically deformed in generally parallel contiguous relation to the upper surface of the body 15 of the inner housing 11. Therefore, improper deformation of the lock arm 20 can be eliminated, thereby preventing incomplete engagement and breakage of the lock arm 20.

Next, a first modified example of the connector 10 will be described with reference to FIG. 8.

Figure 8:
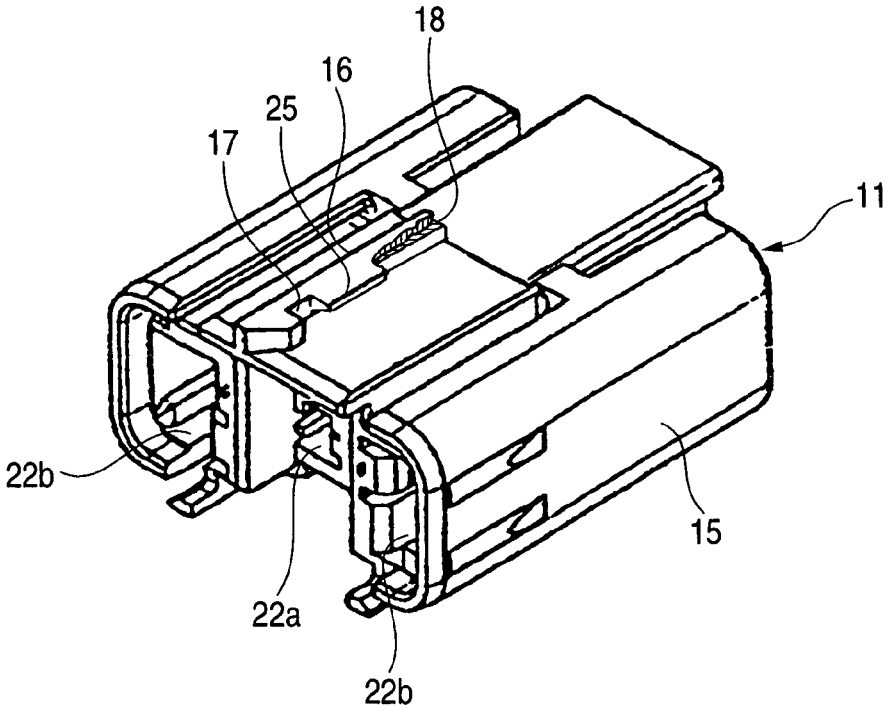
FIG. 8 is a perspective view of an inner housing of a first modified example of the connector of FIG. 1, showing its appearance.

FIG. 8 is a perspective view of an inner housing of the first modified example of the connector of FIG. 1, showing its appearance.

In the first modified example of the connector, a front end of the guide groove 25 in the arm reception portion 16 is open to the completely-retaining portion 18 formed at the front end of the arm reception portion 16. With this construction, during the shifting of the outer housing 12 from the provisionally-fixed condition to the completely-fixed condition, the retaining claw 27 of the lock arm 20 is kept received in the guide groove 25 until a stage immediately before this retaining claw 27 becomes engaged with the completely-retaining portion 18. Therefore, the lock arm 20 is more positively prevented from being deformed away from the upper surface of the body 15 of the inner housing 11.

Next, a second modified example of the connector 10 will be described with reference to FIG. 9.

Figure 9:
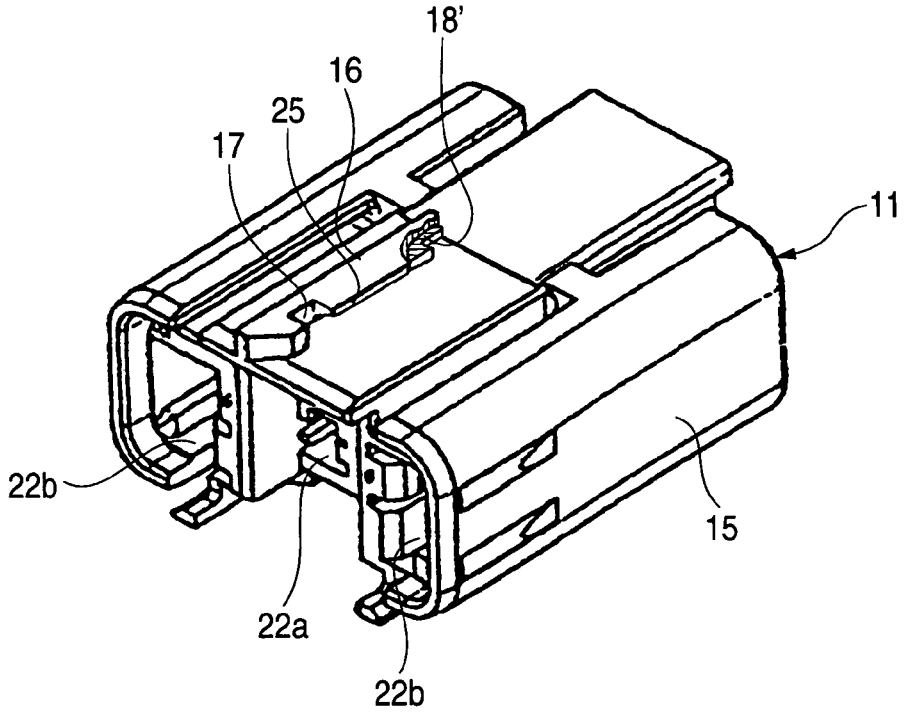
FIG. 9 is a perspective view of an inner housing of a second modified example of the connector of FIG. 1, showing its appearance.

FIG. 9 is a perspective view of an inner housing of the second modified example of the connector, showing its appearance.

In the second modified example of the connector, a completely-retaining portion 18' is defined by a recess formed in a front end portion of the guide groove 25. With this construction, during the shifting of the outer housing 12 from the provisionally-fixed condition to the completely-fixed condition, the retaining claw 27 of the lock arm 20 is kept received in the guide groove 25 until a stage immediately before this retaining claw 27 becomes engaged with the completely-retaining portion 18'. Therefore, the lock arm 20 is more positively prevented from being deformed away from the upper surface of the body 15 of the inner housing 11.

Next, a third modified example of the connector 10 will be described with reference to FIG. 10.

Figure 10:
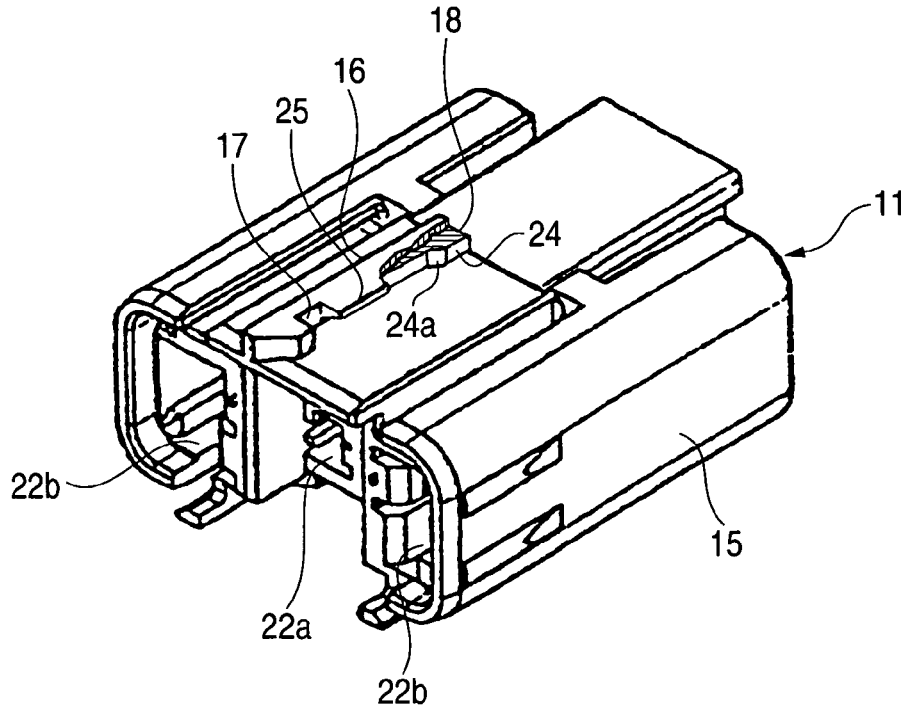
FIG. 10 is a perspective view of an inner housing of a third modified example of the connector of FIG. 1, showing its appearance.
Figure 11:
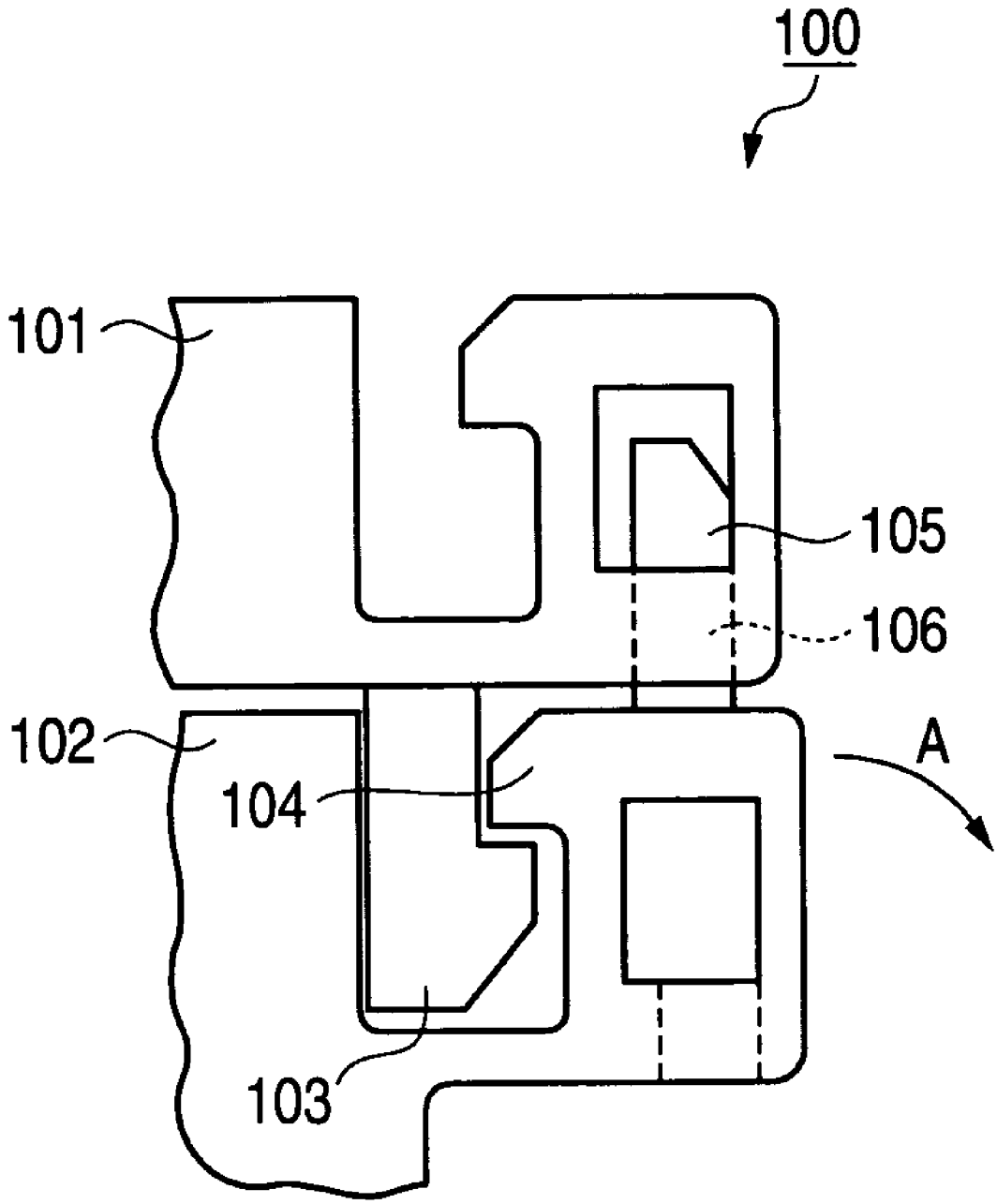
FIG. 11 is a plan view of a lock structure of conventional connector housings.

FIG. 10 is a perspective view of an inner housing of the third modified example of the connector, showing its appearance.

In the third modified example of the connector, a rear surface 24*a* of an interconnecting portion 24 (interconnecting the completely-retaining portion 18 at the front end of the arm reception portion 16 and the front end of the guide groove 25) against which the front surface 28 of the retaining claw 27 of the lock arm 20 can abut is formed into an inclining surface generally conforming to the front surface 28 of the retaining claw 27. With this construction, at the time when the retaining claw 27, after abutting at its front surface 28 against the interconnecting portion 24, slides past this interconnecting portion 24, the lock arm 20 can be more effectively caused to be elastically deformed in generally parallel contiguous relation to the upper surface of the body 15 of the inner housing 11.

The present invention is not limited to the above embodiments, and suitable modifications can be made without departing from the subject matter of the invention.

For example, the lock arm 20 can be formed at the inner housing 11 instead of being formed at the outer housing 12, and the arm reception portion 16 can be formed at the outer housing 12 instead of being formed at the inner housing 11.

What is claimed is

1. A lock structure of first and second articles which are fitted to each other, comprising a lock arm formed in said first article; and an arm reception portion which has a first retaining portion for retaining engagement with said lock arm in said second article, wherein said first and second articles are fitted to each other by fitting said first article to said second article, and during the time when said first article is attached to said second article:

said lock arm is brought into abutting engagement with said arm reception portion, and is elastically deformed to slide past said first retaining portion, and becomes engaged with a second retaining portion; and said arm reception portion has a guide portion extending to said second retaining portion, and a distal end portion of said lock arm is received between said guide portion and an outer surface of said first article.

2. A connector comprising a tubular inner housing having a generally rectangular cross-section;

an outer housing capable of fitting to the said inner housing;

an elastically deformable lock arm formed on one of said inner housing and said outer housing, extending in a connector fitting direction of said tubular body; and a strip-like arm reception portion formed on the other of said inner housing and said outer housing, extending in the connector fitting direction of said tubular body;

wherein a provisionally-retaining portion and a completely-retaining portion are formed respectively at a first end and a second end of said arm reception portion, so that a guide groove is defined along the connector fitting direction between said provisionally-retaining portion and said completely-retaining portion, said inner housing and said outer housing are provisionally fixable to each other by engaging said lock arm with said provisionally-retaining portion, said inner housing and said outer housing are completely fixable to each other by engaging said lock arm with said completely-retaining portion, after moving said lock arm from said provisionally-retaining portion to said completely-retaining portion in said guide groove and wherein said arm reception portion has a guide portion extending to said completely-retaining portion, and a distal end portion of said lock arm is received between said guide portion and an outer surface of the other of said inner housing and said outer housing.

3. A connector according to claim 2, wherein said lock arm is formed in said outer housing, and said arm reception portion is formed in said inner housing, and said outer housing further including a receiving groove formed along the connector fitting direction to receive said arm reception portion therein.

4. A connector according to claim 2, wherein a retaining claw is formed on and projects laterally from a distal end of said lock arm, and a front surface of the retaining claw is formed into an inclining surface.

5. A connector according to claim 2, wherein an interconnecting portion which interconnects said second end of said guide groove an said completely-retaining portion forms a step.

6. A connector comprising:

a tubular inner housing having a generally rectangular cross-section an outer housing capable of fitting to the said inner housing;

an elastically deformable lock arm formed on one of said inner housing and said outer housing, extending in a connector fitting direction of said tubular body; and a strip-like arm reception portion formed on the other of said inner housing and said outer housing, extending in the connector fitting direction of said tubular body;

wherein a provisionally-retaining portion and a completely-retaining portion are formed respectively at a first end and a second end of said arm reception portion, so that a guide groove is defined along the connector fitting direction between said provisionally-retaining portion and said completely-retaining portion, said inner housing and said outer housing are provisionally fixable to each other by engaging said lock arm with said provisionally-retaining portion, said inner housing and said outer housing are completely fixable to each other by engaging said lock arm with said completely-retaining portion, after moving said lock arm from said provisionally-retaining portion to said completely-retaining portion in said guide groove, and wherein said provisionally-retaining portion is in a form of a recess formed in one side edge surface of said arm reception portion.

7. A connector according to claim 6, wherein said guide groove is smaller in depth than said provisionally-retaining portion and said first end of said guide groove communicates with said provisionally-retaining portion with a step formed therebetween.

* * * * *